US012582203B2

(12) United States Patent
Escaravage

(10) Patent No.: US 12,582,203 B2
(45) Date of Patent: Mar. 24, 2026

(54) SNAP-THRU GRID FASTENER FOR MESH FABRICS

(71) Applicant: Bethaney Escaravage, Gaithersburg, MD (US)

(72) Inventor: Bethaney Escaravage, Gaithersburg, MD (US)

( * ) Notice: Subject to any disclaimer, the term of this patent is extended or adjusted under 35 U.S.C. 154(b) by 91 days.

(21) Appl. No.: 18/603,600

(22) Filed: Mar. 13, 2024

(65) Prior Publication Data

US 2025/0288064 A1 Sep. 18, 2025

(51) Int. Cl.
*A44B 17/00* (2006.01)

(52) U.S. Cl.
CPC ..... *A44B 17/0076* (2013.01); *A44B 17/0023* (2013.01); *A44B 17/0035* (2013.01); *A44B 17/007* (2013.01)

(58) Field of Classification Search
CPC ..... A44B 17/0076; A44B 17/0023; A44B 17/0035; A44B 17/007
See application file for complete search history.

(56) References Cited

U.S. PATENT DOCUMENTS 2,368,100 A * 1/1945 Boenecke ..... A44B 17/0029 24/681
2,838,821 A * 6/1958 Shur ..... F16B 21/073 24/662
3,050,805 A * 8/1962 Clyne ..... A44B 17/0029 24/619
3,196,512 A * 7/1965 Koehl ..... A44B 17/0017 24/690
3,401,434 A * 9/1968 Daddona, Jr. ..... A44B 17/0035 24/689
4,253,226 A * 3/1981 Takeda ..... A44B 17/0035 264/249
4,735,753 A * 4/1988 Ackermann ..... B29C 43/18 264/479
4,761,863 A * 8/1988 Sugihara ..... A44B 17/0035 24/692
4,805,272 A * 2/1989 Yamaguchi ..... A44B 17/0035 24/693
4,913,174 A * 4/1990 Cusenza ..... A45D 8/001 132/261
5,103,538 A * 4/1992 Ryder ..... A44B 17/0023 24/453
6,038,702 A 3/2000 Knerr
6,442,808 B2 * 9/2002 Fildan ..... A41F 1/006 2/265
7,013,539 B2 * 3/2006 Fildan ..... A44B 17/0035 2/265
8,813,402 B2 8/2014 Ponce
(Continued)

OTHER PUBLICATIONS https://www.itsminelabels.com/product/snappy-tags/?gclid=Cj0KCQjwtJKqBhCaARIsAN_yS_kJ0mMrmo6xCtwS5LL3gj7YuZLIrfqyelU_OQ5StTCYYhkHy5riYJcaAjRdEALw_wcB.
https://www.sailrite.com/DOT-Snap-Fastener-Cloth-to-Cloth-Set-Government-Black?quantity=1&custcol_qty_in_pack=4&gclid=Cj0KCQjwtJKqBhCaARIsAN_yS_IXD9PCOGduT-cryEsG4ZM7WXWnMfyMXDqFL4sbCHI4VIzJh-cJmTEaAj-IEALw_wcB.

*Primary Examiner* — David M Upchurch
(74) *Attorney, Agent, or Firm* — Stanzione & Associates, PLLC; Patrick Stanzione

(57) ABSTRACT

A snap thru grid fastener system for mesh fabrics wherein a snap thru grid component goes through the openings of the mesh fabric and is affixed to the indentations of the receiving component. The snap thru grid fastener system allows for the user to accessorize mesh fabrics without sewing the patch directly to the fabric or relying on single pin systems.

7 Claims, 8 Drawing Sheets

(56) References Cited

U.S. PATENT DOCUMENTS

| | | | | |
|---|---|---|---|---|
| 11,607,030 | B1 | 3/2023 | Bell | |
| 12,207,752 | B1 * | 1/2025 | LeCompte | A44B 17/0041 |
| 2007/0084023 | A1 * | 4/2007 | Fisher | A44B 17/0035<br>24/114.4 |
| 2008/0082114 | A1 * | 4/2008 | McKenna | A61B 17/0643<br>606/153 |
| 2009/0089978 | A1 * | 4/2009 | Sugihara | A44B 17/0035<br>24/90.1 |
| 2014/0317822 | A1 * | 10/2014 | Friedman | A44B 17/0082<br>2/69 |
| 2017/0273413 | A1 | 9/2017 | Katz | |
| 2020/0237056 | A1 * | 7/2020 | Quinn | A44B 17/0017 |
| 2022/0279886 | A1 | 9/2022 | Berger | |

* cited by examiner

SNAP-THRU GRID FASTENER FOR MESH FABRICS

BACKGROUND OF THE INVENTION

People love to collect magnets, patches, hats, and other accessories. People accessorize their vehicles with magnets, water bottles with stickers and backpacks with patches.

Trucker hats have become especially popular with a solid front and mesh back half. Currently, the back half of hats are not accessorized since there are no good accessory options. The current accessories would be a sewn-on patch (often sewn on by the original hat maker) or a metal pin. Most people will not take the time to sew on a patch to their hat. Metal pins are not secure, not comfortable, and are likely to rust once they get wet.

Prior solutions contain one snap which will not provide the stability for a free-standing patch. Multiple snaps are needed and must be laid out in a precise dimension to fit the mesh fabric holes.

Other prior art is only usable for attachment through a single large hole and through a very firm plastic material. That type of design could not fit through the mesh hole and the mesh fabric is not stable enough to support the weight of the charm. The present subject matter seeks to remedy the issue of either needing to sew a patch onto mesh fabric or using a single point pin system.

SUMMARY OF THE INVENTION

In the following description, numerous specific details are set forth to clearly describe the embodiments disclosed herein. However, one skilled in the art will understand that some well-known features have not been described in detail so as not to obscure the invention.

In the following description, like reference numbers are used to identify like elements. Furthermore, the drawings are intended to illustrate major features of the exemplary embodiments in a diagrammatic manner. The drawings are not intended to depict every feature of every implementation and are not drawn to scale.

The present subject matter provides a secure system to attach a patch or plastic charm to your mesh hat or other mesh fabric items. The system allows the user to snap the accessory to the hat and remove it when desired.

The snap grid design ensures the accessory is secured via multiple snap points and won't flop around. The length of the snaps are long enough to allow the snap to fit through the mesh fabric and still snap securely.

The flat underside of the invention ensures it is comfortable on the wearer's head. The plastic design ensures it will not rust when it gets wet in rain or outdoor water activities.

The invention is based on two components:

1) the receiving component (female) and 2) the snap-thru-grid (male)

The receiving component (female) contains the receiving snap sockets where the snap-thru-grid will be inserted and snapped into. The receiving component sockets will use a groove, spring, or cross-opening to secure the snap lip or overhang. The receiving sockets are laid out to match the snap-thru-grid layout. The receiving component includes the decorative accessory face or patch. The component may include sewing holes where a patch can be attached to the component using thread. Alternative receiving components that are all plastic would not require the sewing holes since the decorative face and holes are created as one piece The snap-thru-grid (male) component is composed of a plurality of snaps laid out in a grid shape. The grid is composed of two or more snaps that are placed the correct distance apart to allow for smooth insertion into the mesh fabric. The protruding snaps have a lip or head that is inserted into the receiving component and snapped into place when using a slight amount of force. The snaps are long enough to fit through the mesh fabric holes and snap into the receiver component.

The invention provides a custom layout of snaps for mesh fabric and includes various shapes and sizes. The number of snap points can vary based on the accessory to be attached. The grid provides rigidity and multiple attachment points so that the decorative face of the accessory does not wobble. The underside of the grid is shaped to be comfortable against a user's head or skin.

The snap-thru-grid can also be created to have two sides and attach to two different receiving components. This could be used when a decorative accessory wants to be shown on both sides of the mesh material (e.g., a beach chair with accessory patches on the front and back of the chair)

The length of the snaps is variable. The length may be long enough to push through the mesh fabric, which can be thin or thick depending on the nature of the mesh fabric.

The foregoing detailed description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation.

The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom.

BRIEF DESCRIPTION OF DRAWINGS

FIG. 5 shows a side view of the assembling process after the process is completed.

DETAILED DESCRIPTION OF THE INVENTION

Figure 1:
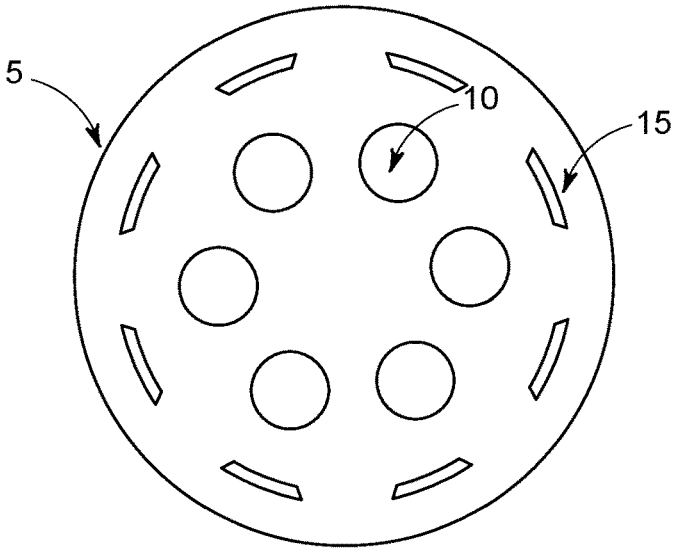
FIG. 1 shows a top view of a receiver component.

FIG. 1 shows a top view of a receiver component 5 wherein the receiver component comprises of snap receiver sockets 10 and patch sewing attachment holes 15. This allows for patches to be used on different mesh fabrics or trucker hats.

Figure 2:
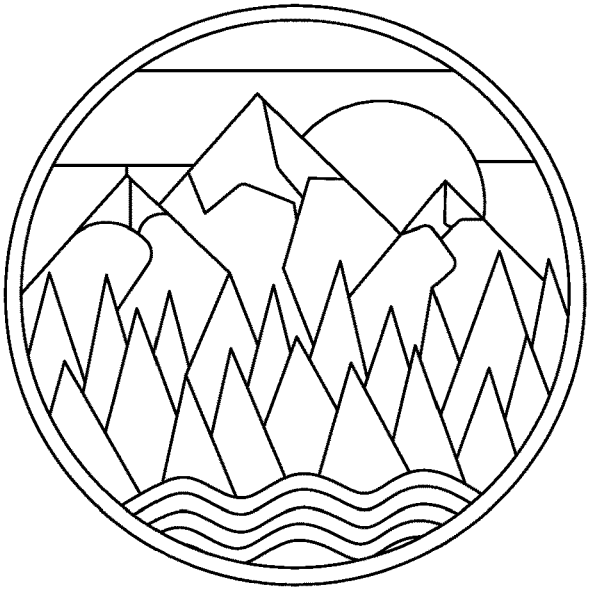
FIG. 2 shows a side view of an example patch and the assembling process of the snap thru grid.
Figure 2:
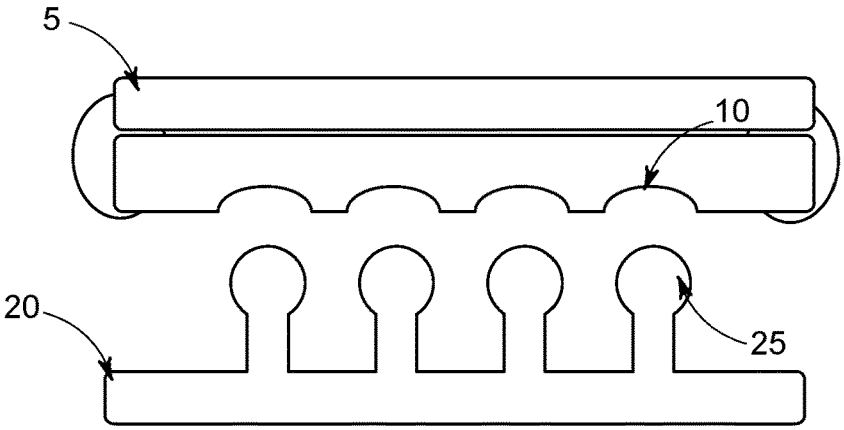

FIG. 2 shows a side view of an example patch and the assembling process of the snap thru grid 20 wherein an example patch is affixed to the receiver component and the snap thru grid snaps 25 into the snap receiver sockets 10 on the receiver component 5.

Figure 3:
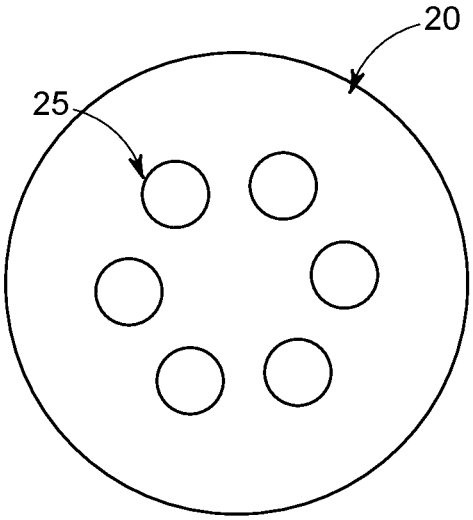
FIG. 3 shows a top view of the snap thru grid component.

FIG. 3 shows a top view of the snap thru grid component 20 wherein the plurality of snaps 25 are in a circular pattern to accommodate the receiver sockets found in FIG. 1.

Figure 4:
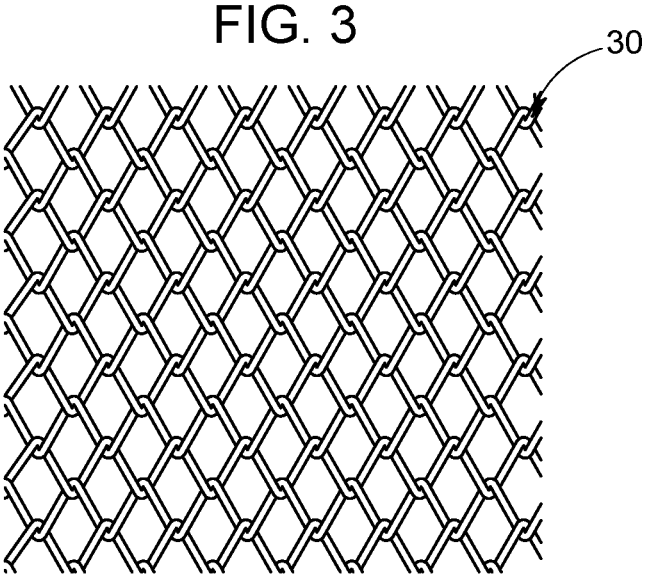
FIG. 4 shows a side view of a mesh fabric that is commonly used on trucker hats.

FIG. 4 shows a side view of a mesh fabric 30 that is commonly used on trucker hats. Mesh fabric can vary requiring the length of the snaps to vary based on said mesh fabric's thickness.

Figure 5:
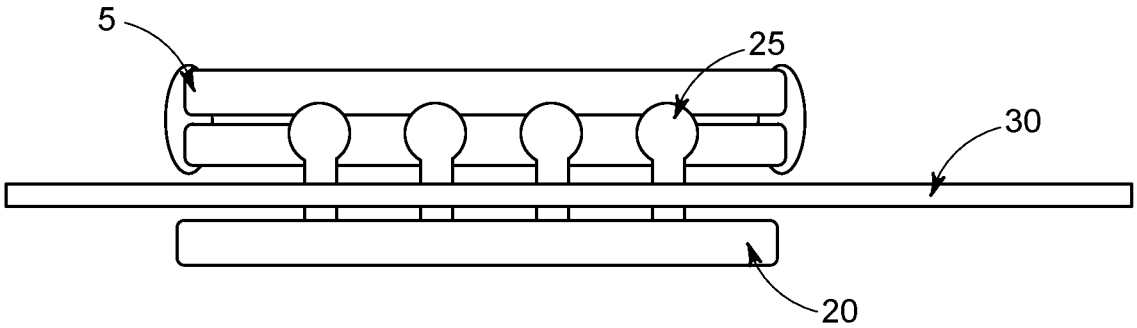
FIG. 5 shows a side view of an example patch and the assembling process of the snap thru grid.

FIG. 5 shows a side view of the assembling process after the process is completed wherein the snaps 25 of the snap thru grid component 20 go through the openings of the mesh fabric 30 and are affixed to the receiver component 5.

Figure 6:
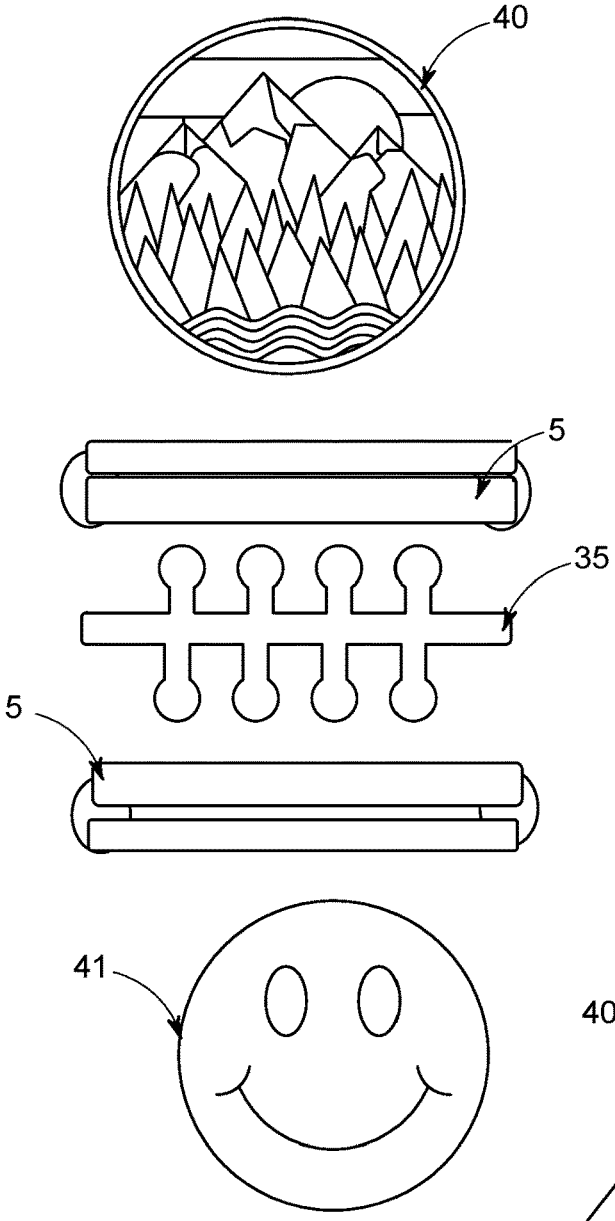
FIG. 6 shows a side view of the assembling process of a two-sided snap-thru grid.

FIG. 6 shows a side view of the assembling process of a two-sided snap-thru grid 35 wherein the snap thru grid is able to affix to two receiver components 5 each with a patch (40, 41) affixed to each receiver component.

Figure 7:
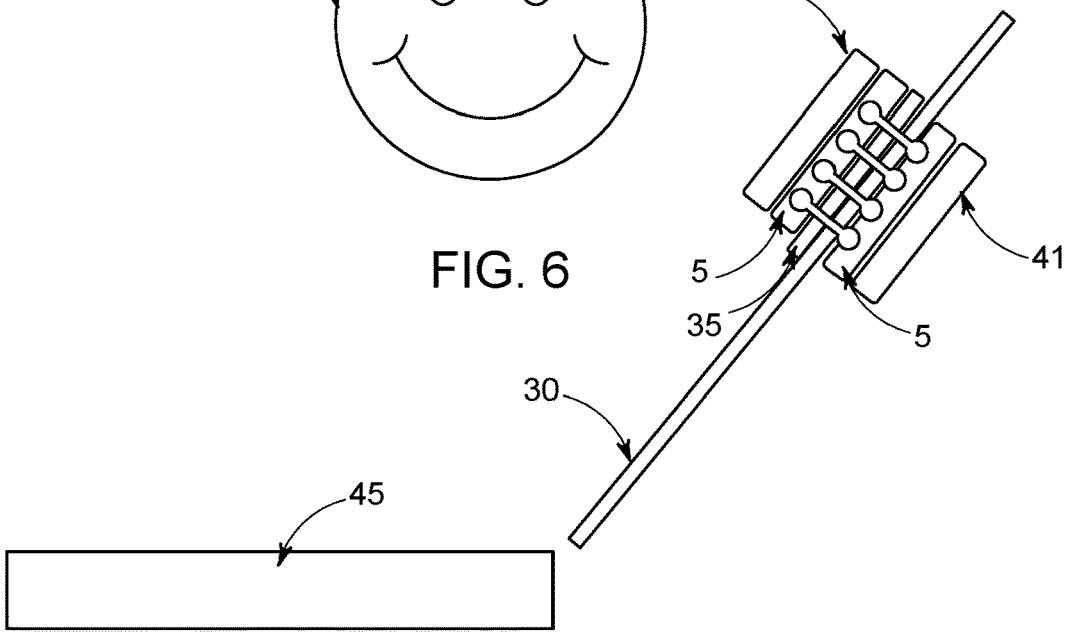
FIG. 7 shows a side view of the assembling process of the two-sided snap-thru grid after the process is completed.

FIG. 7 shows a side view of the assembling process of the two-sided snap-thru grid 35 after the process is completed wherein two example patches are able to be displayed on both sides of a mesh fabric 30 such as a beach chair 45.

Figure 8:
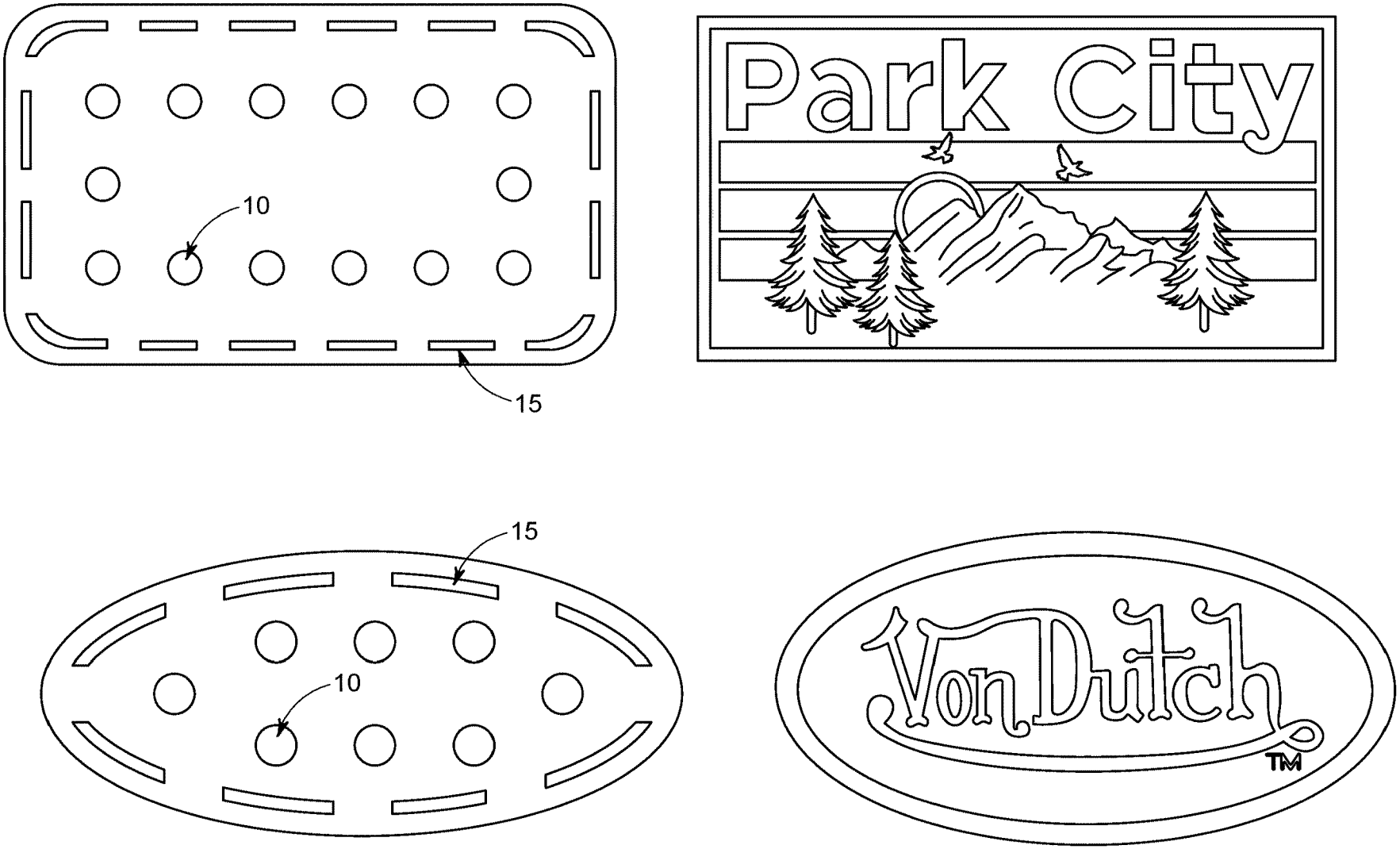
FIG. 8 shows alternative grid layouts to accommodate different shapes and sizes of patches.

FIG. 8 shows alternative grid layouts to accommodate different shapes and sizes of patches wherein the receiver component may accommodate rectangular, circular, oval, triangular, and other common shapes.

Figure 9:
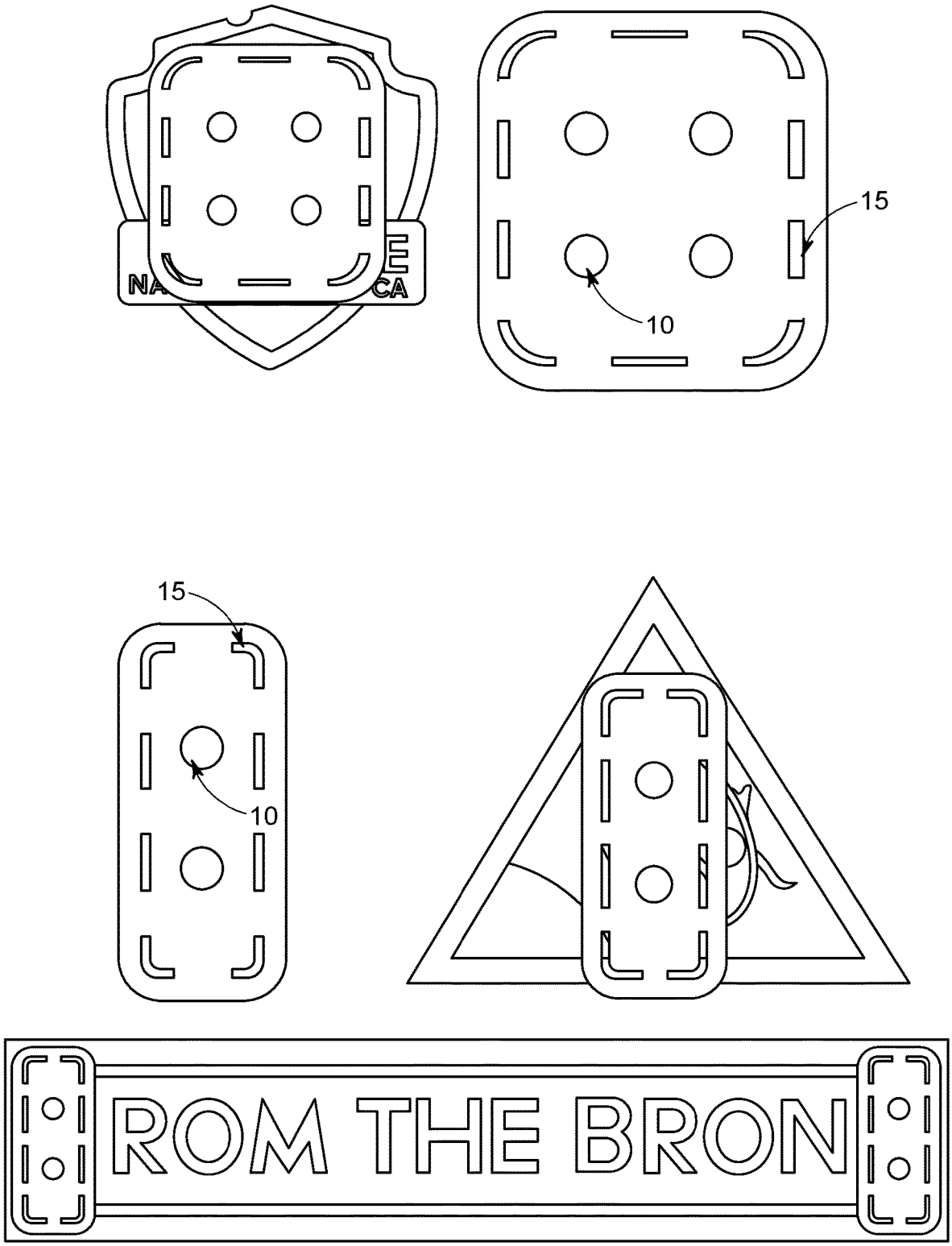
FIG. 9 shows alternative grid layouts to accommodate different shapes and sizes of patches.

FIG. 9 shows alternative grid layouts to accommodate different shapes and sizes of patches wherein the receiver component may accommodate rectangular, circular, oval, triangular, and other common shapes.

Figure 10:
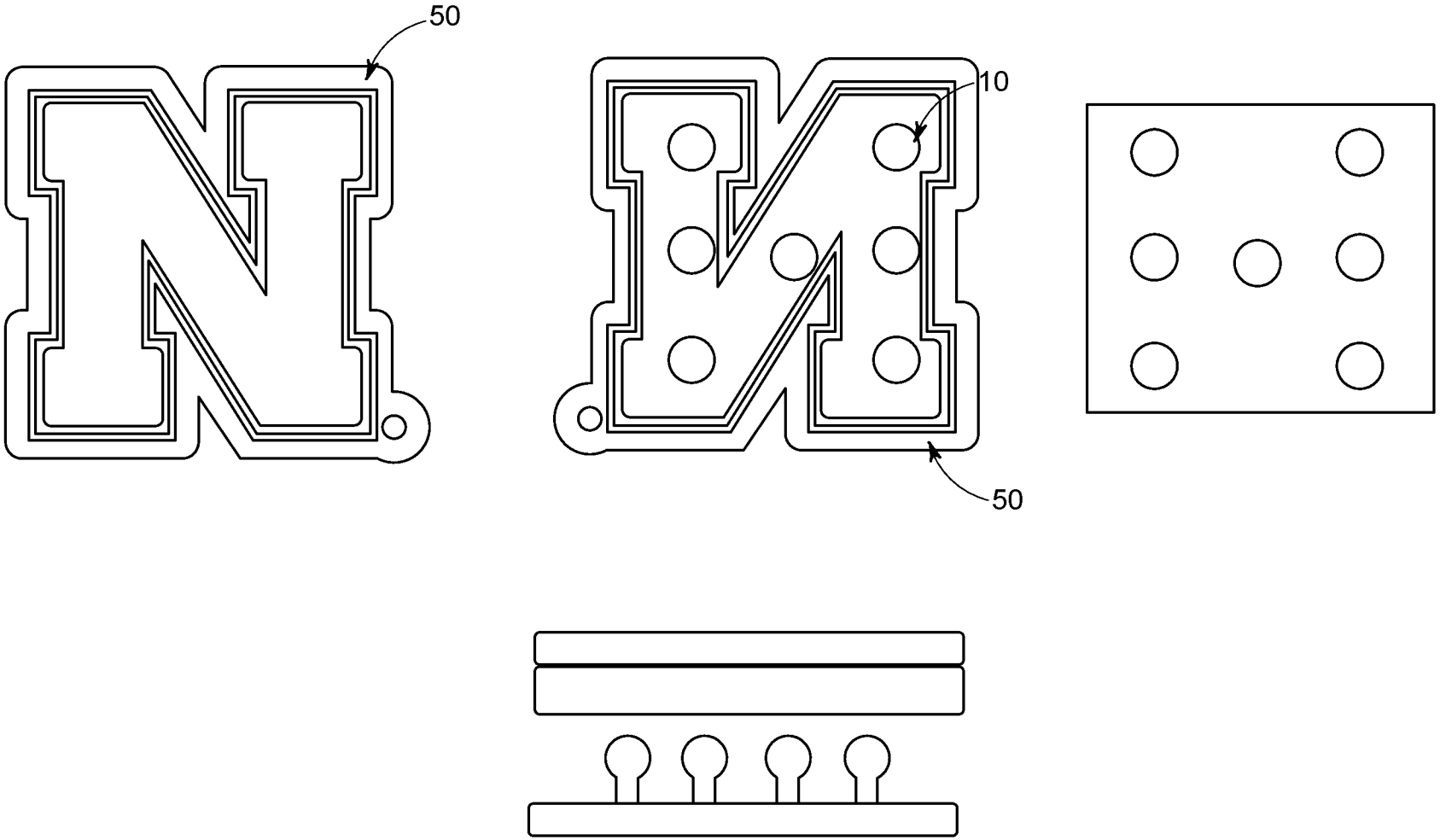
FIG. 10 shows an embodiment wherein the patch is replaced with a plastic charm.

FIG. 10 shows an embodiment wherein the patch is replaced with a plastic charm 50 wherein the charm is a single molded piece that is thick enough to allow for the snap thru receiver sockets 10 to be on the underneath side of the charm.

Figure 11:
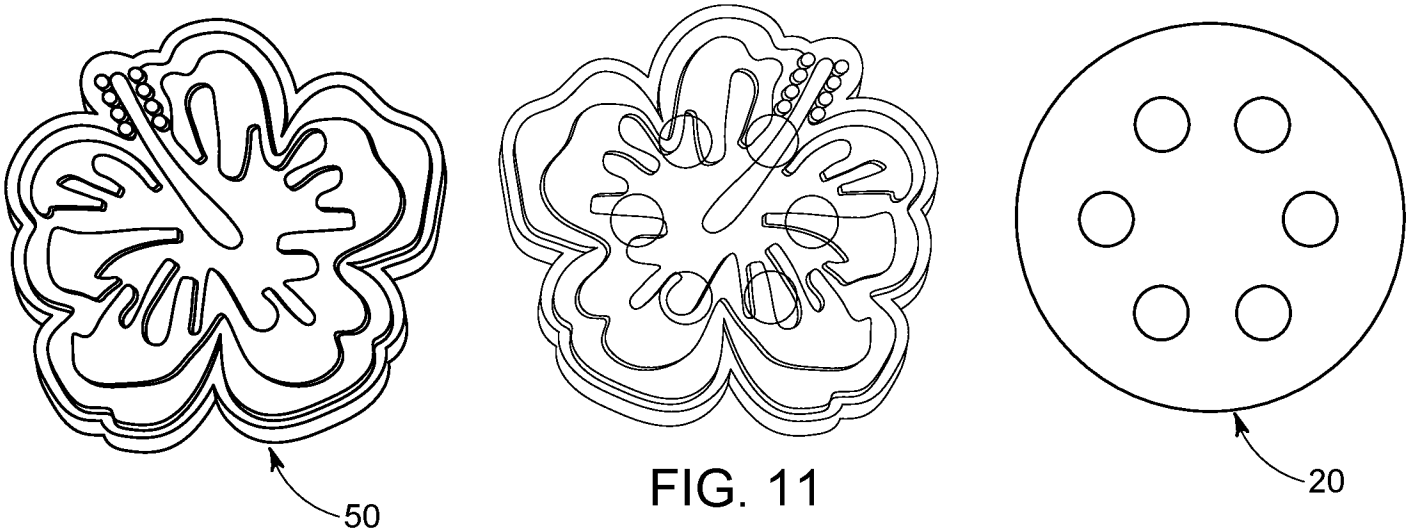
FIG. 11 shows an embodiment wherein the patch is replaced with a plastic charm.

FIG. 11 shows an embodiment wherein the patch is replaced with a plastic charm 50 wherein the charm is a single molded piece that is thick enough to allow for the snap thru receiver sockets to be on the underneath side of the charm. In this example, the receiver sockets are in a circular pattern.

Figure 12:
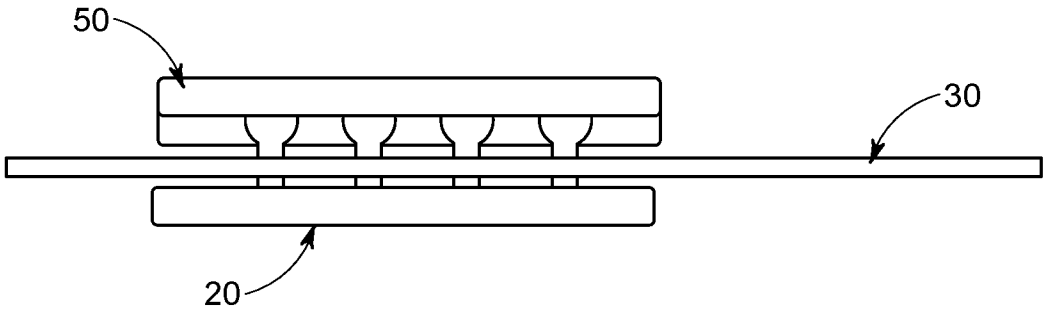
FIG. 12 shows a side view of an example charm and the assembling process of the snap thru grid.

FIG. 12 shows a side view of an example charm 50 and the assembling process of the snap thru grid wherein the charm is a single molded piece designed to accommodate the snap thru grid component 20.

Figure 13:
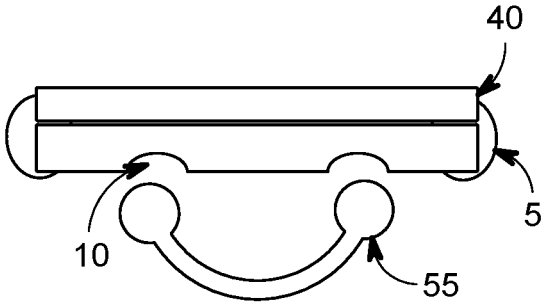
FIG. 13 shows a side view of another embodiment of the snap thru grid.

FIG. 13 shows side view of another embodiment of the snap thru grid wherein curved snap 55 has two snaps that are connected via a curved component.

Figure 14:
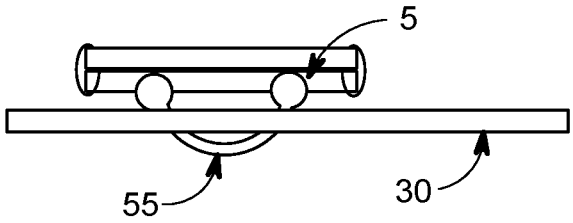
FIG. 14 shows another embodiment of the snap thru grid.

FIG. 14 shows another embodiment of the snap thru grid wherein the curved snap 55 goes through the mesh fabric 30 into receiver component 5 to secure a patch.

The invention claimed is:

1. A snap thru grid fastener system for mesh fabrics, comprising:

a receiver component including at least two receiver sockets to fixedly receive a corresponding snap therein and at least two patch sewing attachment holes to sew the receiver component to patches; and a snap thru grid component including at least two snaps extending therefrom, each snap including:

an extension portion having a length and width to extend through a fabric or a mesh material, and a snap portion being configured to be fixedly received in a corresponding one of the receiver sockets to secure the snap through grid component to the receiver component with the fabric or mesh material sandwiched therebetween.

2. The snap thru grid fastener system according to claim 1, wherein the at least two patch sewing attachment holes are arranged in different patterns and shapes to accommodate different sized patches.

3. The snap thru grid fastener system according to claim 1, wherein the snaps are arranged in different patterns and shapes to correspond in size with different sized patches.

4. A two sided snap thru grid fastener system for mesh fabrics, comprising:

two receiver components, each receiver component including at least two receiver sockets to fixedly receive a corresponding snap therein; and a snap thru grid component including a front and a back side, each of the front and back side including at least two snaps extending therefrom, each snap including:

an extension portion having a length and width to extend through a fabric or mesh material, and a snap portion being configured to be fixedly received in a corresponding one of the receiver sockets to secure the snap through grid component to the receiver component with the fabric or mesh material sandwiched therebetween.

5. The two sided snap thru grid fastener system according to claim 4, wherein each of the two receiver components include at least one patch sewing attachment hole to sew the receiver component to patches.

6. The two sided snap thru grid fastener system according to claim 4, wherein the snap thru grid component further comprises snaps of varying height to extend through fabric and mesh material of different thicknesses.

7. The two sided snap thru grid fastener system according to claim 5, wherein:

the at least two receiver sockets are arranged in different patterns and shapes to correspond with different sized patches; and the snaps are arranged in different patterns and shapes to correspond with different sized patches.

* * * * *